US010844855B2

(12) United States Patent
Hansen

(10) Patent No.: US 10,844,855 B2
(45) Date of Patent: Nov. 24, 2020

(54) AUSTEMPERED GREY IRON SCROLL AND METHOD OF MAKING THEREOF

(71) Applicant: TRANE INTERNATIONAL INC., Davidson, NC (US)

(72) Inventor: George Hansen, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 285 days.

(21) Appl. No.: 15/857,206

(22) Filed: Dec. 28, 2017

(65) Prior Publication Data

US 2018/0187678 A1 Jul. 5, 2018

Related U.S. Application Data

(60) Provisional application No. 62/440,698, filed on Dec. 30, 2016.

(51) Int. Cl.

| | |
|---|---|
| ***F04C 18/02*** | (2006.01) |
| ***C21D 5/00*** | (2006.01) |
| ***F04C 29/12*** | (2006.01) |
| ***F04C 23/00*** | (2006.01) |

(52) U.S. Cl.

CPC ..... *F04C 18/0215* (2013.01); *C21D 5/00* (2013.01); *F04C 29/124* (2013.01); *C21D 2211/001* (2013.01); *F04C 23/008* (2013.01); *F04C 2230/40* (2013.01); *F05C 2201/0439* (2013.01); *F05C 2201/0445* (2013.01); *F05C 2251/02* (2013.01); *F05C 2251/10* (2013.01)

(58) Field of Classification Search

CPC . C21D 2211/001; C21D 5/00; F04C 18/0215; F04C 2230/40; F04C 23/008; F04C 29/124; F05C 2201/0439; F05C 2201/0445; F05C 2251/02; F05C 2251/10

USPC ... 418/55.2, 55.1, 55.3, 55.4, 55.5, 55.6, 88, 418/182

See application file for complete search history.

(56) References Cited

U.S. PATENT DOCUMENTS

| | | | | |
|---|---|---|---|---|
| 5,985,052 | A * | 11/1999 | Angilella | C21D 1/20 148/321 |
| 2008/0159893 | A1* | 7/2008 | Caillat | F04C 18/0215 418/55.2 |
| 2010/0092276 | A1* | 4/2010 | Cartwright | F04D 7/045 415/121.1 |
| 2011/0274946 | A1* | 11/2011 | Severing | D21G 1/0246 428/683 |
| 2014/0217052 | A1* | 8/2014 | Brook | B61G 3/04 213/155 |

(Continued)

OTHER PUBLICATIONS

Kovacs et al. "Physical Properties and Application of Austempered Gray Iron", AFS Transactions 93-141 (1991), pp. 283-291.

*Primary Examiner* — Patrick Hamo
*Assistant Examiner* — Paul W Thiede
(74) *Attorney, Agent, or Firm* — Hamre, Schumann, Mueller & Larson, P.C.

(57) ABSTRACT

A scroll compressor includes scroll members that are made of austempered grey iron in whole or in part. The austempering process can increases fatigue strength and toughness of a grey iron while maintaining its good machinability and vibration damping characteristics. Use of austempered grey iron scroll members allows the scroll compressor to improve its capacity, efficiency, and durability.

16 Claims, 3 Drawing Sheets

(56) References Cited

U.S. PATENT DOCUMENTS

2016/0024622 A1* 1/2016 Broda ..... C21D 8/005
148/544
2016/0363121 A1* 12/2016 Yamada ..... F04C 27/005

* cited by examiner

AUSTEMPERED GREY IRON SCROLL AND METHOD OF MAKING THEREOF

FIELD

Embodiments disclosed herein relate generally to a scroll compressor. Specifically, the embodiments disclosed herein relate to an austempered grey iron scroll member and a method for manufacturing the austempered grey iron scroll member.

BACKGROUND

A scroll compressor is a device for pumping, compressing, and pressurizing fluids such as refrigerant, gas, or air. The scroll compressor is also called spiral compressor, scroll pump, or scroll vacuum pump.

A scroll compressor can be used in a vapor compression system, such as for example an air conditioner employing refrigerant as the working fluid. The scroll compressor includes two intermeshing scroll members: an orbiting scroll member and a fixed scroll member. The vane geometry of the scroll members may be involute, Archimedean spiral, or hybrid curves. The fixed scroll member is fixed to the compressor body. The orbiting scroll member is coupled to a drive shaft and orbits eccentrically in a path defined by the fixed scroll member without rotating. The orbiting motion creates a crescent shaped pocket that travels between the two scroll members with increasingly smaller volume. At the outer portion of the two intermeshing scroll members, the crescent shaped pocket traps and moves refrigerant gas toward the center of the intermeshing scroll members where the refrigerant gas is discharged. The pocket becomes increasingly smaller as the refrigerant gas moves toward the center of the intermeshing scroll members, and thereby the refrigerant gas is compressed and pressurized, accompanied by an increasing temperature. The scroll members constantly resist high pressure, wear, and temperature during the operation of the scroll compressor.

SUMMARY

Embodiments disclosed herein relate generally to a scroll compressor. Specifically, the embodiments disclosed herein relate to an austempered grey iron scroll member and a method for manufacturing the austempered grey iron scroll member.

In some embodiments, a scroll for a scroll compressor includes an austempered grey iron wrap.

In some embodiments, a scroll compressor includes an austempered grey iron fixed scroll member and an austempered grey iron orbiting scroll member.

In some embodiments, a heating, ventilation, and air conditioning (HVAC) system includes a scroll compressor having an austempered grey iron fixed scroll member and an austempered grey iron orbiting scroll member.

In some embodiments, a method of preparing an austempered grey iron scroll member includes austenitizing a grey iron scroll casting at a temperature of about 600° C. to about 1000° C. to obtain an austenitized grey iron scroll followed by austempering at a temperature of about 250° C.-about 471° C. for a time of about 30 minutes-about 4 hours where the austenitized grey iron is transformed to form ausferrite having a matrix structure including high carbon retained austenite and acicular ferrite.

In some embodiments, a method of preparing an austempered grey iron scroll member includes austenitizing a grey iron at a temperature of about 600° C.-about 1000° C. to obtain an austenitized grey iron and austempering the austenitized grey iron at a temperature of about 250° C.-about 471° C. for a time of about 30 minutes-about 4 hours to obtain an austempered grey iron.

BRIEF DESCRIPTION OF THE DRAWINGS

References are made to the accompanying drawings that form a part of this disclosure, and which illustrate embodiments in which devices, systems and methods described herein can be practiced.

FIG. 1 illustrates a scroll compressor containing austempered grey iron scroll members, according to an embodiment.

DETAILED DESCRIPTION

Figure 1A:
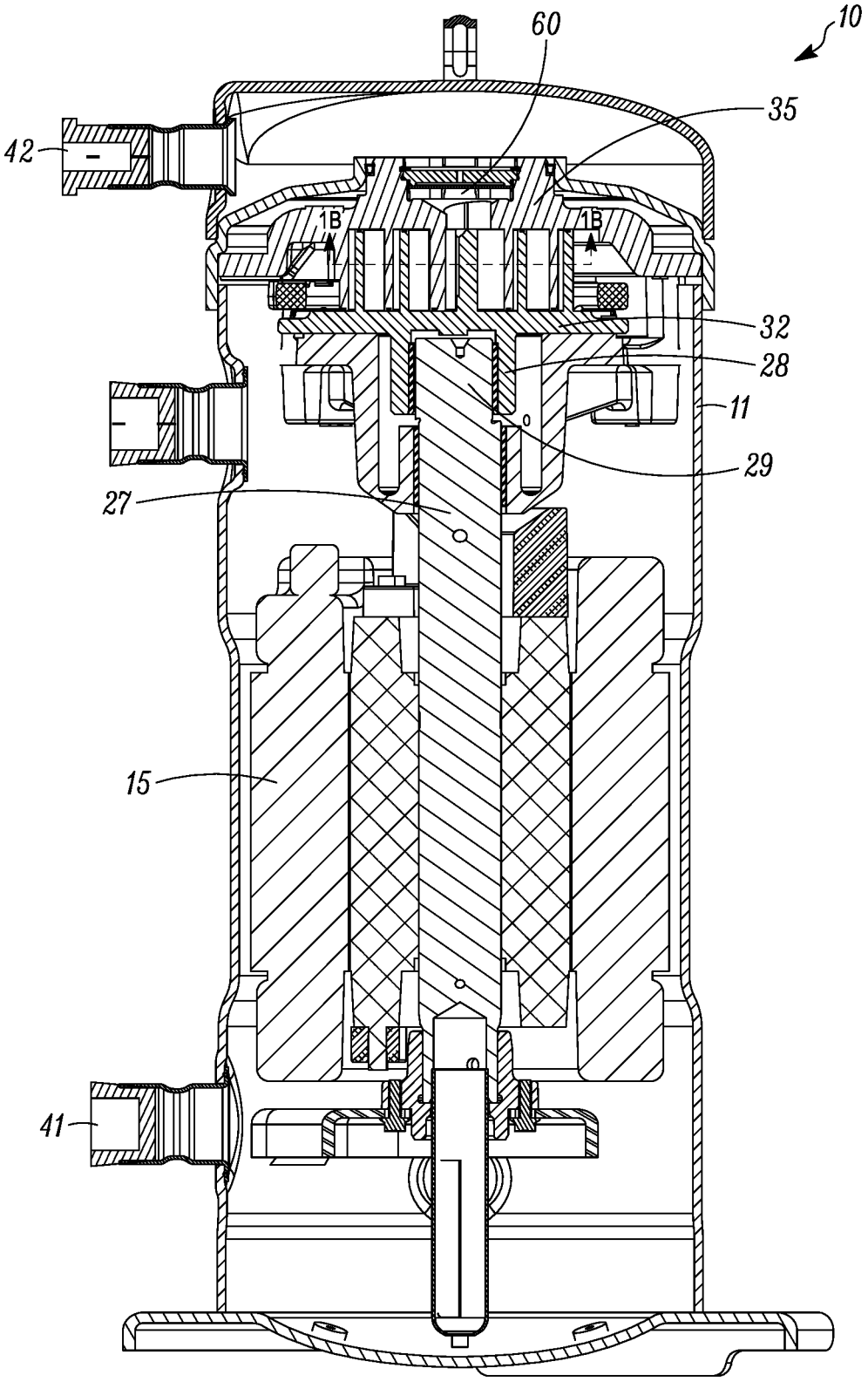
FIG. 1A schematically illustrates a sectional view of the scroll compressor.

The efficiency, capacity, and durability of a scroll compressor largely depend on the material of its scroll members. The scroll members can be made of graphitic cast irons that are readily cast in a mold. The graphitic cast irons are hard, relatively brittle alloys, principally of iron and carbon.

The graphitic cast irons typically contain 2.0-4.3 wt % of carbon dispersed in a metallic matrix. Although the metallic matrix influences basic strength and hardness of the graphitic cast iron, properties of the carbon including morphology, size, and distribution can have great impact on the properties of the graphitic cast iron, e.g., stiffness, strength, toughness, machinability, etc. Depending on the morphology of the carbon, the graphitic cast irons can be generally classified into grey iron, ductile iron, and compacted graphite iron.

Grey iron is also known as grey cast iron (GCI). Grey iron generally contains 1.5-4.3 wt % carbon and 0.3-5 wt % silicon in addition to manganese, sulfur and phosphorus. The majority of the carbon content in grey iron is present as graphite that appears as flakes dispersed in an iron-silicon matrix. Grey iron exhibits a grey fracture surface due to the presence of the graphite flakes. The graphite flakes contribute little strength or hardness. The tips of the graphite flakes act as preexisting notches, and thus grey iron is relatively brittle in tension. Physical properties of grey iron are affected by the volume percentage of the graphite, the length of the flakes, and the distribution of the graphite in the iron-silicon matrix. The graphite flakes decrease tensile strength, hardness, and ductility of the metallic matrix. Thus, grey iron has relatively low impact and shock resistance. On the other hand, the graphite flakes in grey iron present several desirable physical properties useful for making an affordable, high performance scroll member. For example, grey iron has excellent castability related to the low pouring temperature and favorable liquid-to-solid phase expansion. The presence of graphite flakes and sulfur enhance machinability. Grey iron also has good wear resistance, as the graphite flakes self-lubricate and provide pockets for oil retention. In addition, grey iron has good damping capacity and thermal conductivity, and has favorable elastic modulus. These physical properties are particularly useful for improving performance of a scroll member.

In the United States, grey irons are commonly classified by their minimum tensile strength; e.g. class 20, 30 and 40 grey irons respectively have a nominal tensile strength of 20,000 psi, 30,000 psi, and 40,000 psi. Higher tensile strength grey iron has lower proportion of carbon content. For example, class 20 contains a high proportion of carbon content, and class 35 grey irons or above contains a low proportion of carbon content. A low carbon grey iron is referred to a grey iron containing a low carbon content.

Ductile iron is also referred to as nodular iron or spheroidal graphite iron. The graphite in ductile iron appears as spheroids rather than individual flakes in grey iron. This is because magnesium is added to desulfurize the molten graphitic iron, causing the graphite to solidify as spherical nodules instead of flakes. Ductile iron exhibits a linear stress-strain relation, a considerable range of yield strengths and, as its name implies, tensile ductility. Compared to grey iron, ductile iron has higher ductility, elastic modulus, tensile and fatigue strength, but ductile iron has inferior tribological behavior, less damping capacity, worse machinability, and lower castability. The increased stiffness (modulus) of ductile iron may compromise efficiency of the scroll members by preventing conformance. The less damping capacity is associated with increased sound. The inferior machinability and the lower castability may cause a higher manufacturing cost for a scroll member.

Compacted graphite iron is also known as vermicular graphite iron. The graphite in compacted graphite iron appears as blunt flakes, which are shorter and thicker than those in grey iron. The blunt flakes are generally interconnected to each other. This graphite morphology and the physical properties of compacted graphite iron are midway between those of the grey and ductile irons. However, compacted graphite iron is hard to produce at low cost and high consistency.

Compared to ductile iron and compacted graphite iron, grey iron can be an attractive material to make scroll members. Due to low modulus, the scroll members made from grey iron can be compliant to each other for good sealing. The scroll members made from grey iron can self-lubricate and have good wear resistance. The scroll members made from grey iron can have beneficial damping capacity and thermal conductivity. Further, the scroll members can be easily cast into complex involute shapes at low cost. Grey iron can potentially be used to make low cost, high performance scroll members. However, grey iron scroll members may have limited fatigue strength and wear resistance (contact pressure), and thus, under extreme operating conditions, the scroll members may break or wear excessively.

It would be desirable that a scroll member can be made with a material that combines the beneficial characteristics of grey iron including castability, machinability, vibration damping, low elastic modulus, and tribology with satisfactory bending fatigue strength and wear resistance to withstand increased gas pressure (involute bending loads and tip contact pressure).

Improvements to the physical properties of grey iron disclosed herein are for a scroll member of a compressor to have high performance in capacity, durability, and efficiency. Embodiments disclosed herein relate generally to a scroll compressor. Specifically, the embodiments disclosed herein relate to an austempered grey iron scroll member and a method for manufacturing the austempered grey iron scroll member.

The austempered grey iron scroll members disclosed herein have significantly improved mechanical strength, hardness and durability relative to standard as-cast grey iron scroll cast material. Austempered grey iron (AGI) maintains favorable physical properties of grey iron such as good castability, machinability, self-lubrication, good damping capacity, thermal conductivity, and favorable elastic modulus. In an embodiment, the tensile strength of a class 40 iron can be increased by about 30% using a high temperature (about 371° C.) austempering treatment. As the bending fatigue strength of grey iron is positively related to the tensile strength, the bending fatigue strength can also be increased by a similar degree. Currently, the scroll involute bending fatigue loading is limited to ~13 ksi to ensure adequate reliability. The austempering treatment described herein has the capability to increase the bending fatigue strength to approximately 17 ksi while maintaining appropriate machinability. Further, due to the metastable austenite component of the austempered matrix and transformation to hard martensite at the wear interface, wear resistance of austempered irons can be increased disproportionally to the increase in bending fatigue strength. As such, the austempered grey iron scroll members can withstand higher pressure, tensile force, and temperature without wearing and breaking during a long operation of the scroll compressor, which in turn improves durability of a scroll compressor. In addition, the geometries of the austempered grey iron scroll members, such as for example height, width, wrap curvature, root radius, etc., can be designed in accordance with a desired fatigue strength to meet the operating conditions of the scroll compressor. In some embodiments, the wraps of the austempered grey iron scroll members can be made thinner and taller, which increases capacity and efficiency of a scroll compressor. In some embodiments, the wrap curvature of the austempered grey iron scroll members can be sharper. In some embodiments, the root radius of the austempered grey iron scroll members can be smaller. In some embodiments, the geometry of the austempered grey iron scroll members may be reduced as compared to traditional scroll members not made of austempered gray iron. A scroll compressor having austempered grey iron scroll members can exhibit a combination of excellent efficiency, capacity, and durability.

In an embodiment, a method disclosed herein for manufacturing austempered grey iron scroll members includes an austempering process. Austempering is an isothermal heat treatment applied to high carbon steel or iron castings. The austempering process disclosed herein can significantly improve some mechanical properties, such as for example hardness, fatigue strength, wear resistance, tensile strength, etc., of grey iron while maintaining its favorable properties such as machinability, damping capacity, wear resistance and thermal conductivity. Thus, the austempering process disclosed herein can improve performance of a scroll compressor with a relatively low cost.

The advantages of austempered grey iron scroll members become more readily apparent upon reference to the following description and drawings. References are made to the accompanying drawings that form a part hereof, and which is shown by way of illustration of the embodiments in which the devices, the systems, and the methods described herein may be practiced.

FIG. 1A schematically illustrates a sectional view of a scroll compressor 10 having austempered grey iron scroll members 32 and 35, according to an embodiment.

Referring to FIG. 1A, the scroll compressor 10 includes a shell 11 that hermetically seals the operating mechanism. In an embodiment, the scroll compressor 10 is a refrigerant fluid compressor. However, it will be understood that the scroll compressor 10 may also be configured for use as compressing, pressurizing, or pumping fluids other than the refrigerant. A motor 15 connects and drives a drive shaft 27. A crank pin 28 connects the drive shaft 27 to an orbiting austempered grey iron scroll member 32 through a bearing 29. Rotation of the drive shaft 27 and the crank pin 28 thus draws the orbiting austempered grey iron scroll member 32 around in an orbital path. Refrigerant enters the compressor 10 through an inlet port 41 in the shell 11 and flows over the motor 15. The orbiting austempered grey iron scroll member 32 is constrained to orbit relative to a fixed austempered grey iron scroll member 35. The orbiting motion of the orbiting austempered grey iron scroll member 32 relative to the fixed austempered grey iron scroll member 35 creates pockets that trap the refrigerant gas at the outer portion of the austempered grey iron scroll members 32 and 35. The compressed refrigerant reaches the highest pressure and temperature at the center of the fixed austempered grey iron scroll member 35 and then is discharged through a discharge port 60 that is in fluid communication with the center of the fixed austempered grey iron scroll member 35. In an embodiment, the discharge port 60 is provided with a check valve. If a pressure reaches a predetermined value, the compressed refrigerant gas pushes the check valve open and flows into an outlet port 42.

Figure 1B:
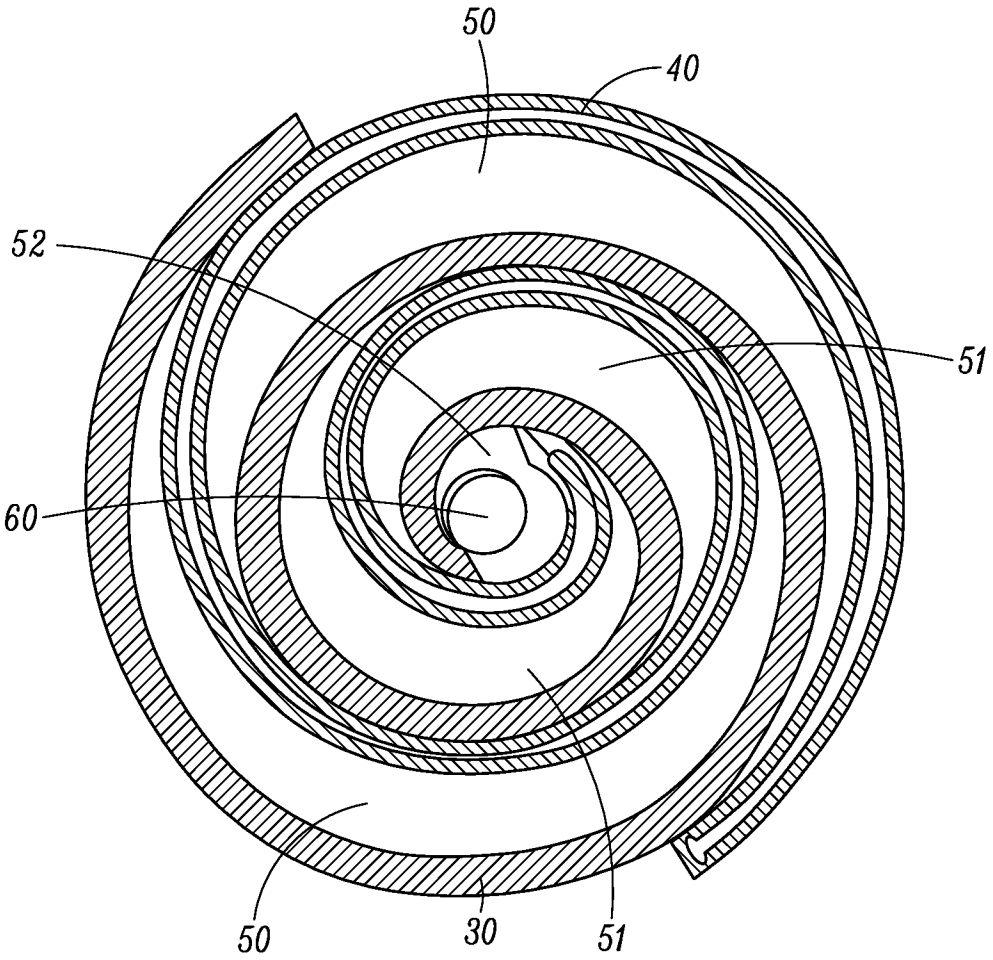
FIG. 1B schematically illustrates a sectional view of scroll wrap of the scroll compressor along a line 1B-1B in FIG. 1A.

FIG. 1B schematically illustrates a sectional view of scroll wraps of the austempered grey iron scroll members 32 and 35 along a line 1B-1B in FIG. 1A.

Referring to FIG. 1B, the austempered grey iron scroll members 32 and 35 have austempered grey iron scroll wraps 30 and 40 on their facing surfaces, respectively. Moving pockets 50, 51 and 52 are formed by means of moving line contacts, as the orbiting austempered grey iron scroll member 32 orbits relative to the fixed austempered grey iron scroll member 35. The capacity of the scroll compressor 10 is largely determined by the size of the moving pockets 50, 51 and 52. The size of the moving pockets 50, 51 and 52 can be increased by reducing the thickness and increasing the heights of the austempered grey iron scroll wraps 30 and 40 of the austempered grey iron scroll members 32 and 35. This would permit trapping a larger amount of refrigerant gas.

Volumes of the pockets 50 decrease as they move toward the center of the austempered grey iron scroll members, compressing the refrigerant. The performance of the scroll compressor 10 partly relies on how well the pockets 50 are sealed, while moving toward the center of the fixed austempered grey iron scroll member 35, and the durability of the scroll compressor 10 partly depends on the mechanical properties of the austempered grey iron scroll members 32 and 35. Compared to grey iron scroll members that are not austempered, the austempered grey iron scroll members 32 and 35 have uniform and consistent hardness, are wear resistant, and have higher impact and fatigue strengths. In some embodiments, the austempered grey iron scroll members 32 and 35 have about 1.75 times higher tensile strength, about 1.5 times higher impact strength, about 1.76 times higher elongation, about 1.71 times higher hardness, and about 1.83 times higher internal damping capacity than grey iron scroll members. In some embodiments, the austempered scroll members 32 and 35 are made from a low carbon grey iron including Class 40 GCI or the like. In an embodiment, the low carbon grey iron can have 3.25 wt. % maximum of carbon content, no more than 0.7 wt. % of copper content, no more than 0.20 wt. % of chromium content, no more than 0.05 wt. % of molybdenum content, no more than 0.05 wt. % of tin content, and no more than 0.015 wt. % of antimony. In some embodiments, the austempered scroll members 32 and 35 are made from class 35 grey iron or the like. In some embodiments, the austempered scroll members 32 and 35 are made from class 30 grey iron or the like. In an embodiment, the scroll members 32 and 35 made from austempered (371° C.) class 40 grey iron can achieve about 56 ksi tensile strength, about 5 ft-lbs of impact strength, about 0.8% elongation, and a moderate ~282 Brinell hardness for maintaining suitable machinability. Higher tensile strength and hardness correlates with improved fatigue strength of the austempered grey iron scroll members 32 and 35. In an embodiment, the austempered scroll members 32 and 35 made from class 40 grey irons can lower the resonant frequency from about 33, 500 Hz to about 29, 500 Hz and increase the internal damping from about 3 to about 9. In an embodiment, the austempered grey iron scroll members 32 and 35 have a unique combination of properties including relatively high strength and wear resistance and very high damping capacity, and thereby the austempered grey iron scroll members 32 and 35 are better compliant to each other, which improve the seal of the moving pockets 50, 51 and 52 better. In an embodiment, the tensile strength and the bending fatigue strength of austempered grey iron scroll members 32 and 35 are increased by ~30%. The increase in the fatigue strength can allow the austempered grey iron scroll members 32 and 35 to tolerate higher pressure, which expands the working condition spectrum of the scroll compressor 10. As the geometries of the scroll members, such as for example height, width, wrap curvature, root radius, etc., are usually designed below the maximum fatigue strength of the material making the scroll members, the increase in the fatigue strength can also allow the geometries to be designed in accordance with a desired fatigue strength to meet the working conditions of the scroll compressor. In some embodiments, the austempered grey iron scroll members 32 and 35 can be made thinner and taller, and thereby increase the capacity of the compressor 10. In some embodiments, the wrap curvature of the austempered grey iron scroll members can be designed to be sharper. In some embodiments, the root radius of the austempered grey iron scroll members can be designed to be smaller. In some embodiments, the geometry of the austempered grey iron scroll members may be reduced as compared to traditional scroll members not made of austempered gray iron.

In an embodiment, the scroll compressor 10 is included in a refrigeration system to improve the efficiency, durability, and capacity of the refrigeration system. For example, the scroll compressor 10 is included in an outdoor compressor of a HVAC system, according to an embodiment. The outdoor compressor receives evaporated refrigerant from an indoor air-handling unit and compresses it. The compressed refrigerant flows through a heat exchanger and then circulates back to the indoor air-handling unit for air conditioning.

It would be understood that the austempered grey iron scroll members 32 and 35 can be partially made from grey cast iron. In some embodiments, the scroll compressor 10 has scroll members whose wraps are made from austempered grey cast iron.

The austempered grey iron scroll members 32 and 35 are prepared by a process including an austempering heat treatment process. In an embodiment, the austempering process is implemented in casting process of grey iron scroll members, with no modification to existing casting chemistry, mold or tooling (geometry). In an embodiment, the austempered grey iron scroll members 32 and 35 are made from austempering casted grey iron scrolls. In an embodiment, the austempered grey iron scroll members 32 and 35 are directly made from austempered grey irons.

Figure 2:
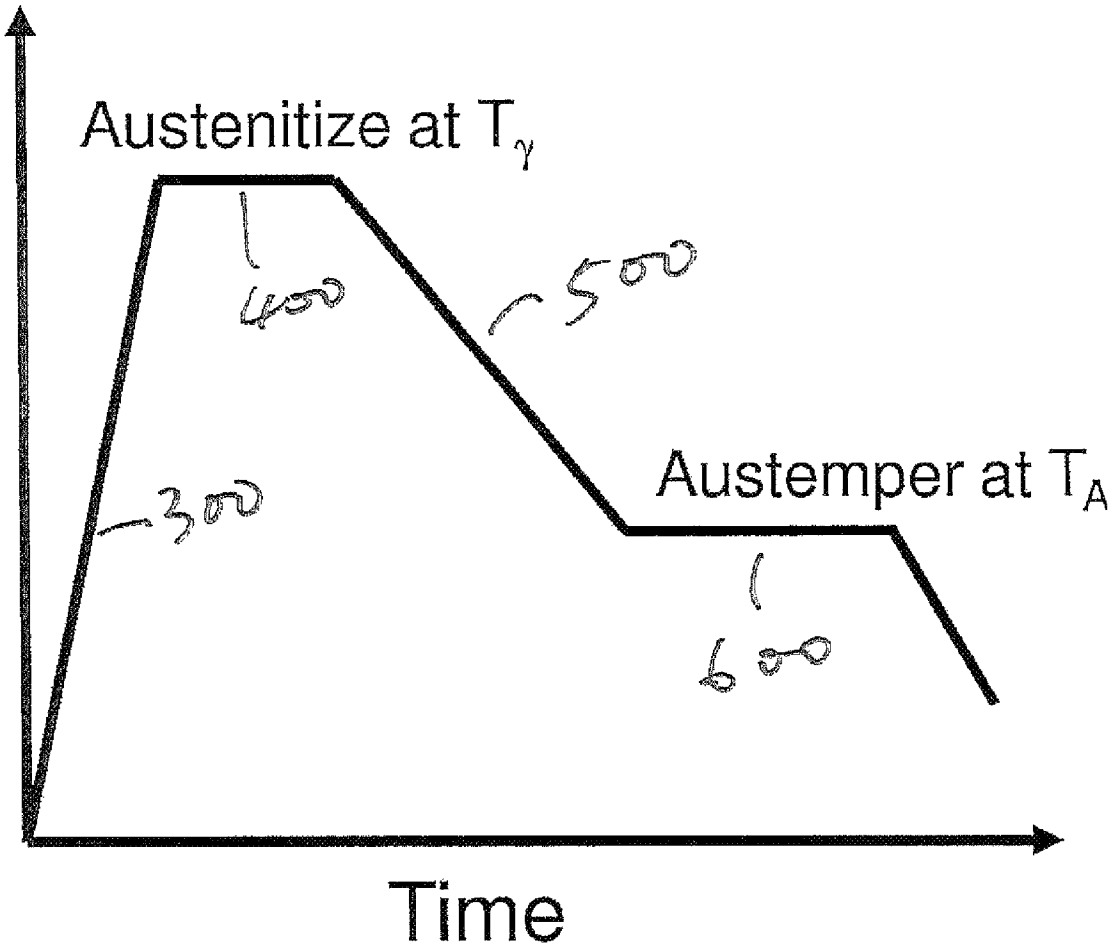
FIG. 2 illustrates an austempering process in casting of grey iron scroll members according to an embodiment.

FIG. 2 schematically illustrates an austempering process for preparing an austempered grey iron scroll member, according to an embodiment. In an embodiment, the austempering process is implemented in casting process of a grey iron scroll member. In another embodiment, the austempering process is used to treat a casted grey iron scroll member. In still another embodiment, the austempering process is used to treat a grey iron.

Referring to FIG. 2, at step 300, casting of a grey iron scroll member is heated to an austenitizing temperature $T_\gamma$. The austenitizing temperature $T_\gamma$ can be about 600° C.-about 1000° C. Depending on the specific chemical composition of grey iron and the desired final properties, the upper-limit of the temperature range for austenitizing includes but not limited to 1000° C., 950° C., 900° C., 850° C., 800° C. and 750° C., and the lower-limit of the temperature range for austenitizing includes but not limited to 600° C., 650° C., 700° C., 750° C., and 800° C. Higher austenitizing temperatures can increase the matrix carbon content and produce higher retained austenite in the final matrix. In some embodiments, the casting of the grey iron scroll member is made from class 20, class 30, or class 40 grey irons, and the austenitizing temperature $T_\gamma$ can be about 871° C. In some embodiments, the casting of the grey iron scroll member is made from class 20, class 30 or class 40 grey irons, and the austenitizing temperature $T_\gamma$ can be about 927° C.

At step 400, the casting of the grey iron scroll member is held at the austenitizing temperature for about 1-about 4 hours depending on the size of the casting. In an embodiment, the casting of the grey iron scroll member is kept at the austenitizing temperature for about 2 hours.

At step 500, the casting of the grey iron scroll member is quickly quenched to an austempering temperature $T_A$. The austempering temperature $T_A$ can be about 250° C.-about 471° C. Depending on the specific chemical composition of grey iron and desired combination of final properties, the upper-limit of the austempering temperature range includes but not limited to 471° C., 421° C., 371° C., and 321° C., and the lower-limit of the austempering temperature range includes but not limited to 250° C., 275° C., 300° C., 325° C., and 350° C. In an embodiment, the austempering temperature $T_A$ is about 260° C. In an embodiment, the austempering temperature $T_A$ is about 316° C. In an embodiment, the austempering temperature $T_A$ is about 371° C., which can provide a meaningful increase in fatigue strength while maintaining satisfactory machinability (moderate hardness) and acceptable dimensional stability.

At step 600, the casting of the grey iron scroll member is held at the austempering temperature in molten salt bath for isothermal transformation to ausferrite for about 0.5-about 4 hours. The temperature of the molten salt bath must be closely controlled. The austempering step is also precisely time-controlled to avoid over- or under-processing, depending on specific chemical composition of grey iron. In an embodiment, the austempering time for the casting of the grey iron scroll member can be about 60 minutes. In an embodiment, the austempering time can be about 120 minutes. In an embodiment, the austempering time can be about 180 minutes.

In an embodiment, austempering the casting of the grey iron scroll member at about 371° C. for about 60 minutes produces about 25% increases in tensile strength (correlates with fatigue strength). In addition, the Charpy impact energy is increased by about 10%, and the hardness is increased by ~30 HBW10/3000. The casting of the grey iron scroll member treated under this austempering condition still maintains the good machinability and damping capacity.

In some embodiments, the austempered grey iron scroll members 32 and 35 can also be made by a process including obtaining an austempered grey iron and casting grey iron into a fixed or orbiting scroll member. The austempered grey iron is prepared in a process similar to what is described above with respect to FIG. 2.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art with no more than routine experimentation, and all such modifications and equivalents are believed to be within the spirit and scope of the disclosure as defined by the following claims.

I claim:

1. A scroll compressor, comprising:

a fixed austempered grey iron scroll member;

an orbiting austempered grey iron scroll member;

a motor connecting and driving a drive shaft;

a crank pin connecting the drive shaft to the orbiting austempered grey iron scroll member through a bearing;

a discharge port in fluid communication with the fixed austempered grey iron scroll member; and a shell hermetically sealing the scroll compressor, wherein each of the fixed austempered grey iron scroll member and the orbiting austempered grey iron scroll member includes an austempered grey iron wrap, the orbiting austempered grey iron scroll member is constrained to orbit relative to a fixed austempered grey iron scroll member, rotation of the drive shaft and the crank pin draws the orbiting austempered grey iron scroll member around in an orbital path, the austempered grey iron wrap is made from a low carbon grey iron, and the low carbon grey iron has 3.25 wt. % maximum of carbon content, no more than 0.7 wt. % of copper content, no more than 0.20 wt. % of chromium content, no more than 0.05 wt. % of molybdenum content, no more than 0.05 wt. % of tin content, and no more than 0.015 wt. % of antimony.

2. The scroll compressor of claim 1, wherein the austempered grey iron wrap has about 56 ksi tensile strength.

3. The scroll compressor of claim 1, wherein the austempered grey iron wrap has about 5 ft-lbs of impact strength.

4. The scroll compressor of claim 1, wherein the austempered grey iron wrap has about 0.8% elongation.

5. The scroll compressor of claim 1, wherein the austempered grey iron wrap has about 282 Brinell hardness for suitable machinability.

6. The scroll compressor of claim 1, wherein the austempered grey iron wrap has a resonant frequency of about 29,500 Hz and an internal damping of about 9.

7. The scroll compressor of claim 1, wherein the austempered grey iron wrap is made from a process including casting a grey iron wrap from a low carbon grey iron, austenitizing the grey iron wrap at a temperature Ty of about 600° C.-about 1000° C. to obtain an austenitized grey iron wrap, and austempering the austenitized grey iron wrap at a temperature T.A. of about 250° C. about 471° C. for an austempering time of about 30 minutes about 4 hours.

8. The scroll compressor of claim 7, wherein the austempered grey iron wrap has about 30% higher tensile strength and bending fatigue strength than a non-austempered grey iron wrap.

9. The scroll compressor of claim 7, wherein the austempered grey iron wrap has about 25% increase in tensile strength, about 10% increase in Charpy impact energy, and about 30 HBW10/3000 increase in hardness relative to a non-austempered grey iron wrap.

10. The scroll compressor of claim 7, wherein the austempered grey iron wrap has about 1.75 times higher tensile strength, about 1.5 times higher impact strength, about 1.76 times higher elongation, about 1.71 times higher hardness, and about 1.83 times higher internal damping capacity than a non-austempered grey iron scroll wrap.

11. The scroll compressor of claim 1, wherein the austempered grey iron wrap is made from a process including austenitizing a grey iron at a temperature Ty of about 600° C.-about 1000° C. to obtain an austenitized grey iron, and austempering the austenitized grey iron at a temperature of about 250° C.-about 471° C. for an austempering time of about 30 minutes-about 4 hours to obtain an austempered grey iron.

12. The scroll compressor of claim 1, wherein the discharge port is provided with a check valve.

13. A heating, ventilation, and air conditioning system, comprising the scroll compressor of claim 1.

14. A method for preparing an austempered grey iron scroll member, comprising:

austenitizing a grey iron scroll at a temperature of about 600° C.-about 1000° C. to obtain an austenitized grey iron scroll; and austempering the austenitized grey iron scroll at a temperature of about 250° C.-about 471° C. for about 30 minutes-about 4 hours, wherein the grey iron scroll includes a grey iron wrap, the grey iron wrap is made from a low carbon grey iron, and the low carbon grey iron has 3.25 wt. % maximum of carbon content, no more than 0.7 wt. % of copper content, no more than 0.20 wt. % of chromium content, no more than 0.05 wt. % of molybdenum content, no more than 0.05 wt. % of tin content, and no more than 0.015 wt. % of antimony.

15. The method of claim 14, wherein the temperature for austenitizing is about 871° C., the temperature for austempering is about 350-about 390° C. and the time for the austempering is about 60 minutes.

16. A method for preparing an austempered grey iron scroll member, comprising:

austenitizing a grey iron at a temperature of about 600° C.-about 1000° C. to obtain an austenitized grey iron;

austempering the austenitized grey iron at a temperature of about 250° C.-about 471° C. for about 30 minutes-about 4 hours to obtain an austempered grey iron; and making an austempered grey iron scroll member from the austempered grey iron, wherein the grey iron is a low carbon grey iron that contains 3.25 wt. % maximum of carbon content, no more than 0.7 wt. % of copper content, no more than 0.20 wt. % of chromium content, no more than 0.05 wt. % of molybdenum content, no more than 0.05 wt. % of tin content, and no more than 0.015 wt. % of antimony.

* * * * *